United States Patent [19]

Myers et al.

[11] Patent Number: 4,732,270

[45] Date of Patent: Mar. 22, 1988

[54] GARMENT BAG HANGER SUPPORT

[75] Inventors: Jay E. Myers, Laguna Beach, Calif.; M. Todd Myers, New York, N.Y.

[73] Assignee: Andiamo, Inc., Fountain Valley, Calif.

[21] Appl. No.: 944,364

[22] Filed: Dec. 22, 1986

Related U.S. Application Data

[63] Continuation of Ser. No. 805,437, Dec. 5, 1985, abandoned.

[51] Int. Cl.[4] ..... A45C 3/00; A44B 21/00; B65D 85/18

[52] U.S. Cl. ..... 206/289; 206/291; 24/517; 211/94; 211/124; 248/316.5; 248/316.6

[58] Field of Search ..... 206/279, 285–287.1, 206/289–293; 24/516, 517, 519; 223/85, 92, 111; 211/124, 94, 94.5; 248/316.5, 316.6, 340

[56] References Cited

U.S. PATENT DOCUMENTS

| | | | |
|---|---|---|---|
| Re. 31,075 | 11/1982 | London et al. | 206/287 X |
| 2,596,412 | 5/1952 | Kish, Jr. et al. | 206/287.1 X |
| 2,689,631 | 9/1954 | Marks | 206/287.1 X |
| 2,862,586 | 12/1958 | Davis | 206/287.1 |
| 3,035,673 | 5/1962 | Schenkler | 206/291 X |
| 3,335,826 | 8/1967 | Swirles | 206/287.1 |
| 3,542,170 | 11/1970 | Bialo | 206/287.1 X |
| 3,566,456 | 3/1971 | London | 206/279 |
| 3,958,675 | 5/1976 | Rosenblum | 206/287.1 |
| 4,193,482 | 3/1980 | Koff | 206/287 |
| 4,363,388 | 12/1982 | London et al. | 206/287 X |

*Primary Examiner*—Stephen Marcus
*Assistant Examiner*—Sue A. Weaver
*Attorney, Agent, or Firm*—Gausewitz, Carr & Rothenberg

[57] ABSTRACT

This invention provides a hanger supporting device for a garment bag which will accommodate both ordinary hangers and luggage-type hangers. The device includes a plate attachable to a garment bag, a first channel connected to the plate, a second channel carried by the first channel, a third channel pivotally connected to the second channel, and a rail connected to the second channel. The rail is adapted to engage luggage-type hangers. A pad having a notched surface is carried by the third channel and adapted to support ordinary hangers. A latching arrangement releasably holds the third channel adjacent the first channel to retain the hanger in the notches in the pad.

24 Claims, 6 Drawing Figures

FIG. 1.
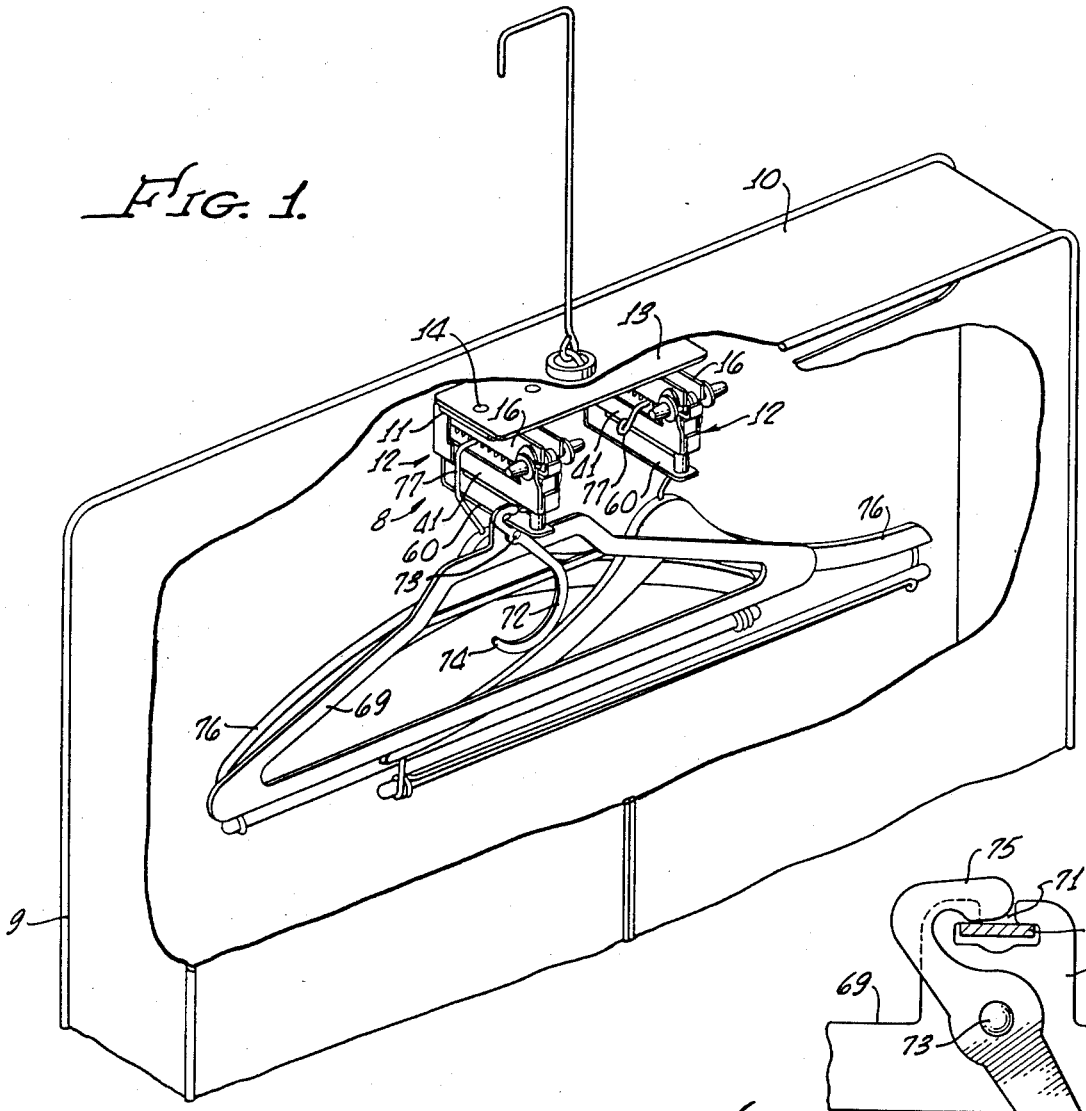
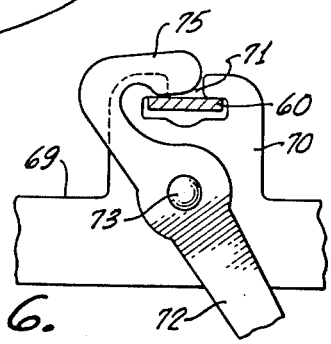
FIG. 6.
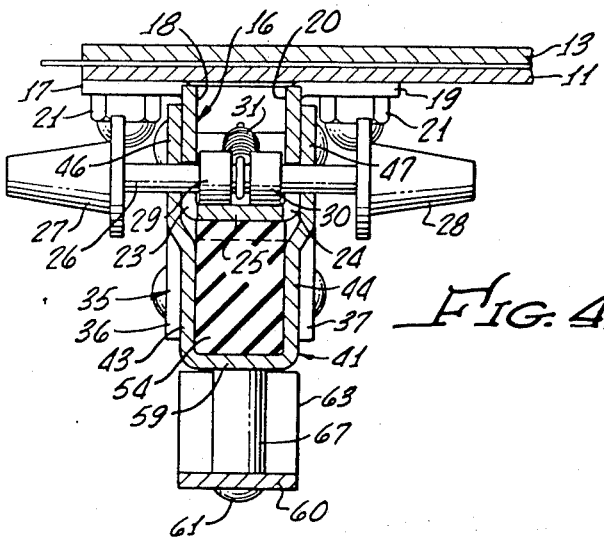
FIG. 4.
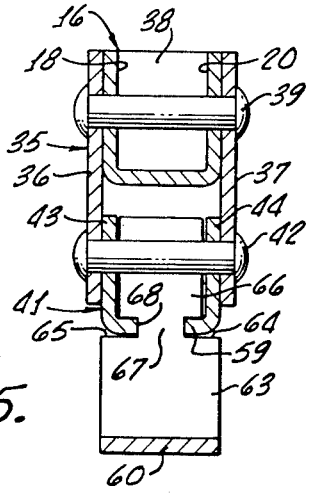
FIG. 5.

GARMENT BAG HANGER SUPPORT

CROSS REFERENCE TO RELATED APPLICATION

This application is a continuation of application Ser. No. 805,437, filed Dec. 5, 1985, for Garment Bag Hanger Support now abandoned.

BACKGROUND OF THE INVENTION

Conventionally garment bags are provided with a support for luggage-type hangers that include a rail carried by a support adjacent the top wall of the garment bag. The rail receives the notched necks of luggage-type hangers which have pivotal hook elements that lock the hangers to the rail. The disadvantage of this is that it requires the clothes to be transferred from their normal hangers to the special luggage-type hangers when the garment bag is to be packed. Also, the luggage-type hangers do not have the contour of many ordinary hangers used in supporting garments in a closet, nor do they have locking elements for holding trousers to the crossbar of the hanger. Conventional garment hangers cannot be used with the rail of such garment bags because there is no means for confining these hangers and holding them in position.

It has been proposed, as disclosed in U.S. Pats. Nos. 4,363,388 and Re 31,075, to provide a garment bag support which includes a pivotal element with a notched pad to receive the hook portions of ordinary hangers. When in a latched position, the hook portions of the hangers are confined and cannot escape the notches. The garment bag support lacks versatility, however because it requires the use of conventional hangers and will not permit luggage-type hangers to be employed. The latter type of hanger may be preferred in certain instances because it is flat and thin, enabling a maximum number of garments to be packed within a garment bag.

Thus, the prior art lacked a truly universal versatile garment bag hanger supporting arrangement.

SUMMARY OF THE INVENTION

The present invention provides a garment bag hanger support which overcomes the problems of prior art. The device of the invention provides a dual function, being capable of supporting both ordinary hangers and luggage-type hangers. The hangers need not be all of one king, but may be mixed as used.

The device includes a support plate to which may be connected two supporting units. Each of these units includes a first channel connected to the plate and a second channel parallel to the first and facing the same direction. A third channel is carried by the first channel at one of its ends and is pivotally connected to one end of the second channel. This allows the second channel to pivot downwardly relative to the first. A stop limits the movement so that the second channel is at an acute angle relative to the first channel. The open side of the second channel is adjacent the bottom of the first channel and includes a resilient notched pad adapted to receive the hook portions of ordinary hangers. A latch arrangement releasably holds the second channel next to the first channel. When in the raised latched position, the hooks of the hangers are confined and cannot escape the notches in the pad.

The second channel carries a rail and spaced parallelism with it on the side opposite from the pad. The rail is adapted to receive the notches of luggage-type hangers which can be locked to the rail by rotating their hook portions.

Thus, the garment bag support can accommodate both types of hangers. Moreover, it is of simplified rugged design and easily and conveniently used.

BRIEF DESCRIPTION OF THE DRAWINGS

FIG. 1 is a fragmentary perspective view of the garment bag hanger support within a garment bag;

FIG. 4 is a transverse sectional view taken along line 4—4 of FIG. 3;

FIG. 5 is a transverse sectional view taken along line 5—5 of FIG. 3; and

FIG. 6 is a fragmentary sectional view illustrating the connection of a hanger to the rail of the supporting unit.

DETAILED DESCRIPTION OF THE INVENTION

Figure 2:
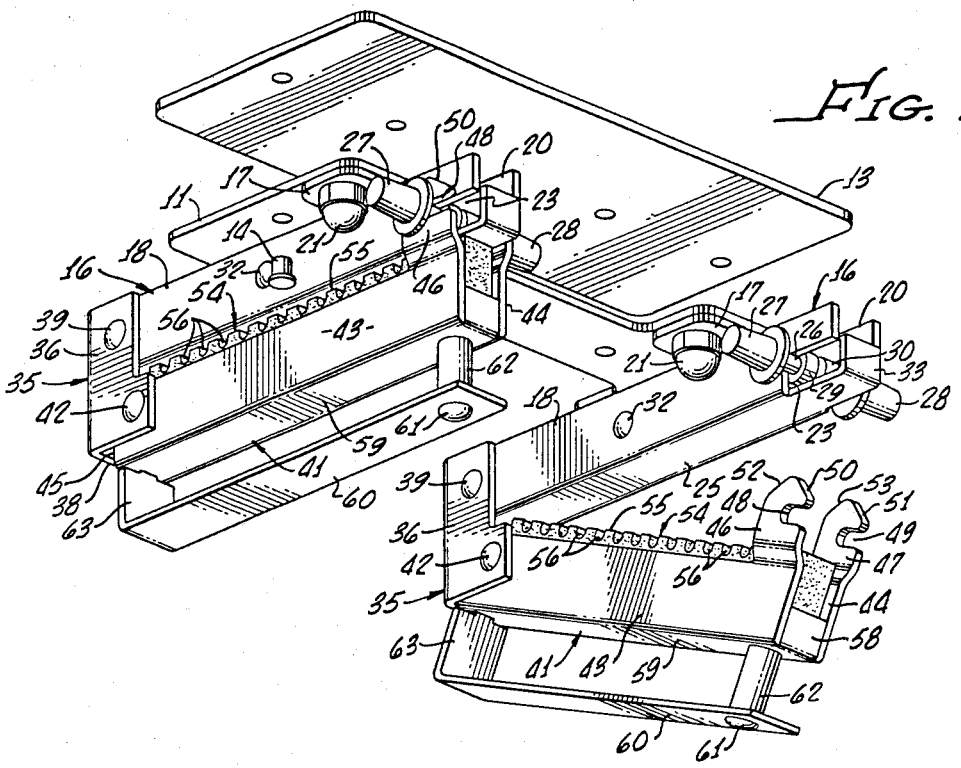
FIG. 2 is an enlarged perspective view of the garment bag hanger support removed from the garment bag.

The garment bag hanger support 8 of this invention is shown in FIG. 1 as associated with a garment bag 9, attached to the undersurface of its top wall 10. The hanger support 8 includes an elongated metal plate 11 and two identical spaced support assemblies 12 attached to the plate. The garment bag 9 is provided with a plate 13 to which the plate 11 of the hanger support 8 is attached by rivets 14 (see FIG. 2).

Each assembly 12 includes a fixed upper channel 16, U-shaped in cross section. A tab 17 extends laterally outwardly from the upper edge of one side flange 18 of the channel 16 and a similar tab 19 projects laterally in the opposite direction from the upper edge of the outer side flange 20 of the channel 16. The tabs 17 and 19 are spaced apart longitudinally of the channel. Apertures are formed in the tabs 17 and 19 to receive bolts or studs which are meshed with cap nuts 21. This connects the support assemblies 12 to the plate 11. The open side of the channel 16 faces the plate 11 and the upper edges of the flanges 18 and 20 are adjacent the plate.

At the forward end of the channel 16, identical slots 23 and 24 are formed in the side flanges 18 and 20, adjacent the bottom wall 25 of the channel. A latching pin 26 extends transversely of the channel 16 through the slots 23 and 24 projecting outwardly on either side of the channel 16. Tapered gripping elements 27 and 28 with enlarged inner base portions are on the outer ends of the latching pin 26. At the central part of the pin 26, between the side flanges 18 and 20 of a channel 16, are closely spaced enlargements 29 and 30. This retains the pin 26 against substantial axial movement relative to the channel 16. In the space between the enlargements 29 and 30, the pin 26 is engaged by one end of a tension spring 31. The opposite end of the tension spring 31 fits around a transverse pin 32 that extends between the side flanges 18 and 20 inwardly of the slots 23 and 24. Therefore, the pin 26 is biased by the spring 31 to the inner ends of the slots 23 and 24. It can be moved forwardly against the force of the spring by engaging the gripping portions 27 and 28 on the outer ends of the pin 26. The forward movement of the pin 26 is limited, however, by an upturned end 33 of the bottom wall 25 of the channel 16 which closes off the entrances to the slots 23 and 24. Thus, the pin 26 cannot escape from the slots 23 and 24.

At the rearward end of the channel 16 is a shorter vertical channel 35, which has side flanges 36 and 37 that complementarily receive the rearward ends of the side flanges 18 and 20 of the channel 16. The central wall 38 of the channel 35 engages the rearward end of the channel 16. A rivet 39 extends through the side flanges 36 and 37 of the channel 35 and the side flanges 18 and 20 of the channel 16 to hold these two channels together, with the channel 35 perpendicular and fixed relative to the channel 16.

Figure 3:
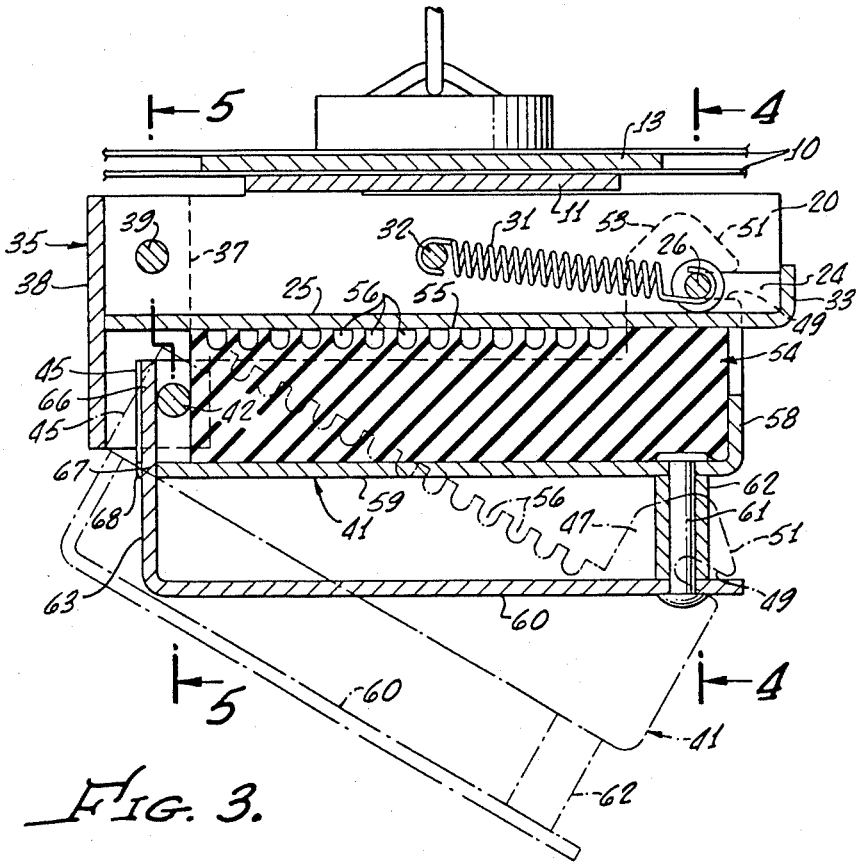
FIG. 3 is an enlarged longitudinal sectional view of one of the hanger support units.

The channel 35 extends below the channel 16, with the lower ends of the side flanges 36 and 37 being of increased width. Received between the lower ends of the side flanges 36 and 37 is the rearward end of a third channel 41, which has its open side facing the channel 16. A transverse rivet 42 extends through the side flanges 36 and 37 of the channel 35 and also through the side flanges 43 and 44 of the channel 41, connecting the two channels together. The rearward end 45 of the channel 41 is spaced from the central wall 38 of the channel 35. Therefore, the channel 41 can pivot downwardly about the rivet 42, which acts as a pivot pin from the solid line position of FIG. 3 to the position indicated in phantom. Downward rotational movement is terminated by the engagement of the rearward end 45 of the channel 41 with the lower edge of the central wall 38 of the channel 35, limiting the rotation of the channel 41.

At the forward end of the channel 41 are upward projections 46 and 47, extending from the upper edges of the side flanges 43 and 44. The projections 46 and 47 are flared outwardly adjacent the side flanges 43 and 44 so that they are dimensioned to receive the forward end of the channel 16. Slots 48 and 49, which are parallel to the longitudinal axis of the channel 41, extend inwardly from the forward edges of the projections 46 and 47. Above the slots 48 and 49 are inclined upper forward edges 50 and 51 of the projections 46 and 47. The rearward upper edges 52 and 53 of the two projections 46 and 47 also are inclined.

As a result of this construction, when the channel 41 is pivoted upwardly about the pin 42, the inclined forward edges 50 and 51 will strike the transverse latching pin 26 inwardly of the gripping portions 27 and 28, actings as cams to move the latching pin 26 forwardly against the bias of the spring 31. Upon further upward movement the pin 26 reaches the slots 48 and 49, being pulled into these slots by the spring 31. The pin 26 then securely holds the channel 41 in its upper latched position, where it is parallel to the channel 16. The channel 41 can be released for downward pivotal movement, however, by pulling on the gripping portions 27 and 28 of the pin 26, removing the pin from the slots 48 and 49 to free the channel 41 for downward rotational movement.

Received within the channel 41, between the pivot pin 42 and the projections 46 and 47, is a rectangular rubber pad 54. The pad 54 is of a depth such that its upper surface 55 is positioned above the upper edges of the side flanges 43 and 44 of the channel 41. In the upper latched position of the channel 41 the upper edge 55 of the pad 54 is adjacent to the bottom wall 25 of the upper channel 16. A series of transverse notches 56 extends across the upper surface 55 of the pad 54 for receiving the hook portions of conventional coat hangers when the supporting device is in use, as explained below. An upwardly bent tab 58 at the forward end of the bottom wall 59 of the channel 41 retains the pad 54 against movement forwardly out of the channel.

Spaced below the channel 41 and parallel to it is a flat rail 60. At its forward end the rail 60 is connected to the channel 41 by means of a rivet 61 that passes through the forward end portion of the rail 60 and through the bottom wall 59 of the channel 41. A sleeve 62 around the rivet 61 extends between the wall 59 and the rail 60 to keep the forward end of the rail spaced from the channel 41. At its rearward end the rail is bent upwardly at 90° to provide an upward projection 63. This portion of the rail is provided with transverse slots 64 and 65 and an upper end part 66 above the slots. This provides a relatively narrow neck 67 between the slots 64 and 65 and below the end part 66. This neck 67 fits within a recess 68 in the rearward end of the bottom wall 59 of the channel 41. That positions the rearward end part of the bottom wall 59 adjacent the recess 68, within the slots 64 and 65. This serves as the attachment of the rearward part of the rail 60 to the channel 41, cooperating with the rivet 61 and its sleeve 62 to fix these two elements in a spaced and parallel relationship.

The rail 60 is for supporting locking hangers of the type commonly used in luggage. This kind of hanger 69 includes a neck 70 provided with an undercut slot 71 in its end. The rail 60 is dimensioned in width to be receiveable in the notch 71. The hanger 69 also includes a member 72 which is pivotal about a pin 73 connected to the neck of the hanger. An enlarged hook portion 74 is at one end of the member 72 and at the other end is a transverse lock 75. In one position of the member 72, with the hook portion 74 upwardly above the neck 70, it is usable as a conventional hanger. Additionally, the hook 74 may be rotated downwardly, exposing the slot 71. The hanger 69 then may be slid onto the rail 60, with the rail entering the slot 71. The member 72 then is rotated to bring the lock 75 over the rail, closing the slot and preventing removal of the hanger69 from the rail (FIG. 6). The hanger 69 will remain on the rail 60 until the member 72 is rotated to allow it to be removed.

As a result of this construction the garment bag hanger support device 8 of this invention can support luggage-type hangers 69, or conventional hangers 76, or a combination of the two, as shown in FIG. 1. The luggage-type hanger 69 may be attached to the rail 60 when the latter is in either position, that is, latched upwardly with the channel 41 or pivoted downwardly. Conventional hangers 76 are positioned with their hook portions 77 located in the notches 56 in the upper surface 55 of the pad 54. This is done with the channel 41 pivoted downwardly, which places it at a shallow angle to the horizontal so that the hangers will remain within the notches 57 once positioned there. Then the channel 41 is pivoted upwardly to the latched position with the hangers 76 then captured beneath the channel 16. There they are held securely in place.

The supporting device 8, therefore, offers complete versatility and the capability of using two types of hangers, either alternatively or mixed together. Each supporting unit 12 performs a dual function, that is, the support of two kinds of hangers. The inclusion of two of the supports 12 spaced apart enables the hangers to be alternated laterally with respect to each other as attached to the support, which provides more room for the garments being accommodated within the garment bag.

The foregoing detailed description is to be clearly understood as given by way of illustration and example only, the spirit and scope of this invention being limited solely by the appended claims.

What is claimed is:

1. A garment supporting device for a garment bag comprising a plate adapted for connection to the upper wall of a garment bag, a first channel attached to said plate, a second channel, means for pivotally connecting said second channel to said first channel adjacent one end of said first and second channels for permitting pivotal movement of said second channel toward and away from said first channel, releasable latching means for holding said second channel adjacent said first channel and preventing such pivotal movement, said second channel having an open side facing said first channel and an opposite side having a wall extending therealong, an elongated pad of resilient material received in and carried by said second channel and extending outwardly from said open side thereof, said pad having a surface adjacent said first channel when said second channel is so held adjacent said first channel, said surface having a plurality of transverse notches therein for receiving the hook portions of ordinary hangers which hook portions are retained by said first channel when said second channel is so held adjacent said first channel, and a member attached to and carried by said second channel, said member including a rail in spaced parallelism with said wall of said second channel and being adapted for engagement by locking luggage-type hangers, whereby said garment support can accommodate both ordinary and luggage-type hangers.

2. A device as recited in claim 1 in which for said attachment to said second channel said member includes a portion integral with and substantially perpendicular to said rail, said portion of said member having a necked-down section, said second channel at one end thereof having a notch receiving said necked-down section for thereby supporting said member at one end thereof, and a fastener at the opposite end of said rail extending to said second channel for supporting said rail at said opposite end thereof.

3. A device as recited in claim 1 including stop means for limiting the amount of said pivotal movement of said second channel.

4. A device as recited in claim 3 in which said means for pivotally connecting said second channel to said first channel includes an element secured to said first channel and projecting outwardly therefrom, and a pivot pin interconnecting said element and said second channel.

5. A device as recited in claim 1 in which said means for pivotally connecting said second channel to said first channel includes a third channel having side flanges receiving said first channel at said one end of said first channel, and a central wall engaging said one end of said first channel, means for connecting said third channel to said first channel, said third channel projecting beyond said first channel with said side flanges thereof receiving said second channel at said one end of said second channel, said second channel having side flanges, and a pivot pin extending through said side flanges of said third channel and the side flanges of said second channel for permitting said second channel to pivot relative to said third channel and therefore relative to said first channel.

6. A device as recited in claim 5 in which said one end of said second channel is spaced from said central wall of said third channel when said second channel is so held adjacent said first channel, said end of said second channel being engageable with said central wall of said third channel when said second channel is so pivoted away from said first channel for thereby limiting the amount of such pivotal movement.

7. A device as recited in claim 5 in which said first channel has an open side remote from said second channel, whereby said first and second channels face in the same direction.

8. A device as recited in claim 5 in which said first channel includes side flanges, and said means for connecting said third channel to said first channel includes a fastener extending through said side flanges of said third channel and the side flanges of said first channel.

9. A device as recited in claim 5 in which said first channel has side flanges having outer edges adjacent said plate, and tab means projecting outwardly from said outer edges, and including fastener means securing said tab means to said plate.

10. A hanger supporting device comprising a first element including an elongated channel generally U-shaped in cross section, and an elongated pad received in said channel and supported and carried thereby, said pad having an outer surface having transverse notches therein each of which is adapted to receive the hook portion of an ordinary hanger, said transverse notches being on one side of said channel, a second element adjacent said pad for confining hanger hook portions and retaining them in said traverse notches, said first and second elements being movable relative to each other for separating said second element from said pad to allow hanger hook portions to be inserted into or removed from said transverse notches, and a third element adjacent and attached to said first element and including an elongated rail spaced from the opposite side of said channel for engaging and supporting luggage-type hangers, whereby said support device can support both ordinary and luggage-type hangers.

11. A device for retaining and supporting both an ordinary hanger having a hook and a locking luggage-type hanger having a pivotal locking element comprising a first jaw element including a substantially rigid member and a pad supported thereby, said pad having an exposed outer surface, a second jaw element including a substantially rigid member, means interconnecting said first and second jaw elements so as to permit said first and second jaw elements to be selectively placed in a first relative position in which they are spaced apart for permitting the hook of an ordinary coat hanger to be placed therebetween or removed therefrom, and in a second relative position in which said exposed outer surface of said resilient pad is in juxtaposition with said second jaw element for thereby retaining the hook of an ordinary coat hanger between said jaw elements, and permitting one of said jaw elements to carry said ordinary coat hanger, an elongated rail, and means for connecting said rail to one of said jaw elements so that said rail is spaced from said one jaw element and is exposed and unobstructed so that the locking element of a locking luggage-type hanger can be extended over said rail, whereby said device can retain and support a locking luggage-type hanger as well as an ordinary coat hanger.

12. A device as recited in claim 11 in which there are recess means in said exposed outer surface of said pad for receiving the hook of an ordinary coat hanger.

13. A device as recited in claim 11 in which said means interconnecting said jaw elements includes pivot means allowing relative pivotal movement of said jaw elements.

14. In combination with a garment bag, an ordinary coat hanger having a hook and a locking luggage-type hanger having a pivotal locking element, a device for supporting both of said hangers in said garment bag comprising a first jaw element including a substantially rigid member and a resilient member supported thereby, said resilient member having an exposed outer surface, a second jaw element including a substantially rigid member, means connecting one of said jaw elements to said garment bag, said jaw elements being in a first relative position in which said exposed outer surface of said resilient member is in juxtaposition with said second jaw element, and said hook of said ordinary coat hanger is between said exposed outer surface of said resilient member and said second jaw element, so that said hook is retained by said jaw elements and carried by one of said jaw elements, means interconnecting said first and second jaw elements so as to permit said first and second jaw elements to be selectively moved relatively to a second relative position in which they are spaced apart for permitting said hook of said ordinary coat hanger to be placed therebetween or removed therefrom, stop means for limiting movement of said first and second jaw elements from said first relative position to said second relative position, means for selectively and releasably holding said jaw elements in said first relative position, an elongated rail, and means at opposite end portions of said rail for connecting said rail to one of said jaw elements so that said rail is spaced from said one jaw element and is unobstructed and exposed between said end portions thereof, said locking element of said locking luggage-type hanger being extended over said rail intermediate said end portions thereof for securing said locking luggage-type hanger to said rail, whereby said device retains and supports said locking luggage-type hanger as well as said ordinary coat hanger.

15. A device as recited in claim 14 in which said exposed outer surface of said resilient member is on one side of said first jaw element, and said rail is so spaced from the opposite side of said first jaw element.

16. A device as recited in claim 15 in which said second jaw element is so connected to said garment bag.

17. A device for retaining and supporting both an ordinary hanger having a hook and a locking luggage-type hanger having a pivotal locking element comprising a first jaw element, including a substantially rigid member, a second jaw element including a substantially rigid member, means interconnecting said first and second jaw elements so as to permit said first and second jaw elements to be selectively placed in a first relative position in which they are spaced apart for permitting the hook of an ordinary coat hanger to be placed therebetween or removed therefrom, and in a second relative position in which said first jaw element is in juxtaposition with said second jaw element for thereby retaining the hook of an ordinary coat hanger between said jaw elements, and permitting one of said jaw elements to carry said ordinary coat hanger, an elongated rail, and means for connecting opposite end portions of said rail to one of said jaw elements so that said rail is spaced from said one jaw element and is exposed and unobstructed between said end portions thereof so that the locking element of a locking luggage-type hanger can be extended over said rail, whereby said device can retain and support a locking luggage-type hanger as well as an ordinary coat hanger.

18. The method of supporting and retaining both an ordinary coat hanger having a hook projecting therefrom and a locking luggage-type hanger having a locking element which can be moved between an open position and a locked position in which it can extend over a supporting device comprising the steps of providing a first substantially rigid jaw element, supporting a resilient member by said first jaw element so that said resilient member has an exposed outer surface, providing a second jaw element, providing for relative movement between said first and second jaw elements such that said jaw elements may be selectively spaced apart in a first relative position, and may be brought into adjacency with said exposed outer surface of said resilient member in juxtaposition with said second jaw element in a second relative position, providing an elongated rail in spaced adjacency with one of said jaw elements so that a central portion of said rail is exposed and unobstructed, positioning said jaw elements in said first relative position, inserting said hook of said ordinary coat hanger between said jaw elements while said jaw elements are in said first relative position, moving said jaw elements to said second relative position so that said hook of said ordinary coat hanger is between said jaw elements and retained by said resilient member and said second jaw element, positioning said locking luggage-type hanger adjacent said central portion of said rail with said locking element in said open position thereof, and moving said locking element to said closed position thereof so that said locking element extends over said central portion of said rail and locks said locking luggage-type hanger to said rail, thereby to support and retain both said ordinary hanger and said locking luggage-type hanger.

19. The method as recited in claim 18 in which in so providing for relative movement between said first and second jaw elements a pivotal connection is made between said jaw elements.

20. The method as recited in claim 18 in which recess means are formed in said exposed outer surface of said resilient member and said hook of said ordinary coat hanger is positioned in said recess means.

21. The method as recited in claim 18 including the step of latching said first and second jaw elements in said second relative position when said hook of said ordinary coat hanger is so retained.

22. The method as recited in claim 18 including the step of attaching one of said jaw elements to a garment bag.

23. The method as recited in claim 22 in which said second jaw element is so attached.

24. The method as recited in claim 23 in which said elongated rail is so provided in spaced adjacency with said first jaw element.

* * * * *